US006166462A

United States Patent [19]

Finkenbinder et al.

[11] Patent Number: 6,166,462

[45] **Date of Patent: *Dec. 26, 2000**

[54] BYPASS MOTOR/FAN ASSEMBLY HAVING SEPARATE WORKING AIR PASSAGES

[75] Inventors: David B. Finkenbinder, Newville, Pa.; Jeffrey D. Marsden, Kent, Ohio

[73] Assignee: Ametek, Inc., Kent, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/072,035

[22] Filed: May 4, 1998

[51] Int. Cl.[7] ..... K04D 29/44; H02K 9/04

[52] U.S. Cl. ..... 310/63; 417/423.14; 417/423.2; 415/208.1; 415/211.2

[58] Field of Search ..... 310/62, 63; 417/423.1, 417/423.2, 423.14, 366, 424.2; 415/208.1, 211.2

[56] References Cited

U.S. PATENT DOCUMENTS

| | | | |
|---|---|---|---|
| 2,726,807 | 12/1955 | Lewis | 310/62 |
| 2,888,192 | 5/1959 | Cole et al. | 310/62 |
| 4,669,952 | 6/1987 | Forsyth, III et al. | 415/119 |
| 5,394,041 | 2/1995 | Oberdorfer-Bogel | 310/64 |
| 5,734,214 | 3/1998 | Gilliland et al. | 310/89 |

FOREIGN PATENT DOCUMENTS

| | | | |
|---|---|---|---|
| 3-018699 | 1/1991 | Japan | 417/366 |
| 3-023399 | 1/1991 | Japan | 310/62 |
| 4-164199 | 6/1992 | Japan | 310/62 |

OTHER PUBLICATIONS

Translation of Japanese Patent 04–164, 199, Jun. 9, 1992.

*Primary Examiner*—Karl Imayoshi Tamai
*Attorney, Agent, or Firm*—Renner, Kenner, Greive, Bobak, Taylor & Weber

[57] ABSTRACT

A bypass motor/fan assembly for use in applications where moisture laden air is encountered. A motor with a motor cooling fan has a fan end bracket received at one end thereof to isolate the motor and motor cooling fan from a working air fan received on the opposite side of the fan end bracket. A diffuser matingly engages with the fan end bracket. The diffuser and fan end bracket have ramped surfaces thereon which are circumferentially aligned with the working air fan. The ramped surfaces define air flow paths of uniform cross section which pass to exhaust ports which are circumferentially spaced about a fan shell which is received over the fan end brackets, diffuser and working air fan. The fan shell has an air intake aperture at an end thereof. Air passes from the air intake aperture, into the eye of the work air fan, and out of the fan at the circumference thereof into the air paths of uniform cross section and to the exhaust ports. This channeling and ducting of the working air achieves a laminar flow and reduces turbulence and pressure pulses, increasing the efficiency of the working air fan and reducing the noise incident to the operation thereof.

4 Claims, 2 Drawing Sheets

FIG.-1
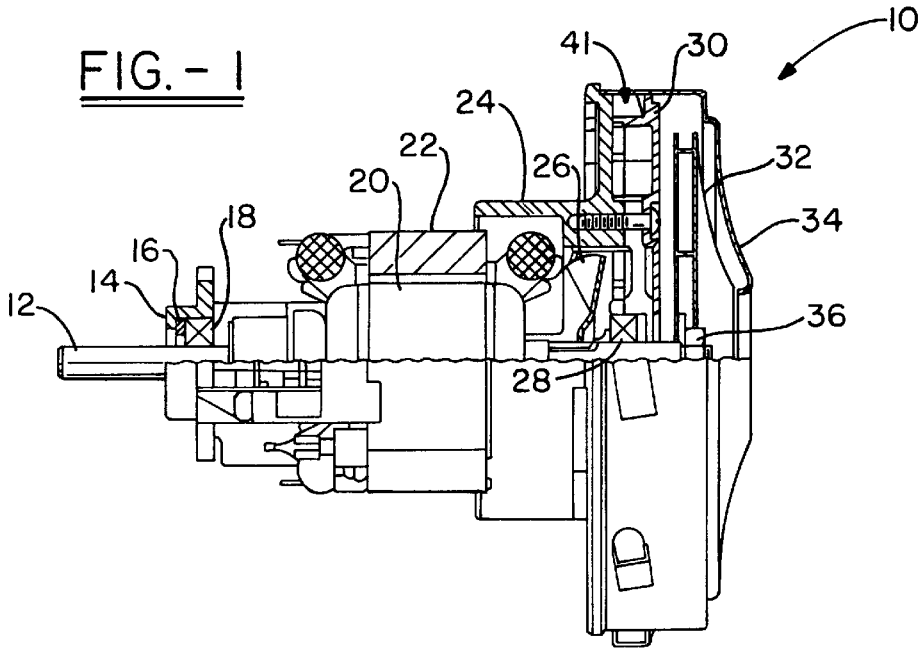
FIG.-2
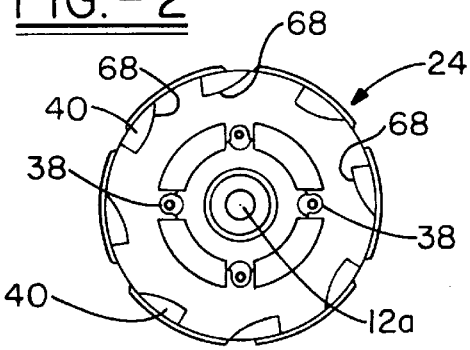
FIG.-3
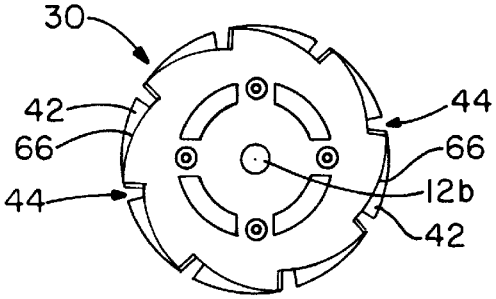
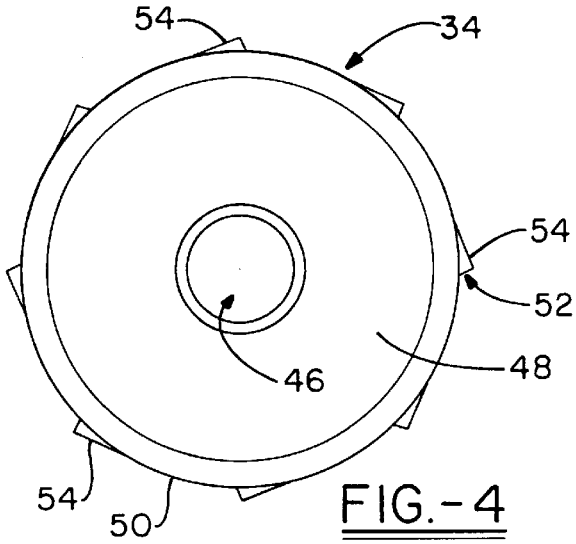
FIG.-4
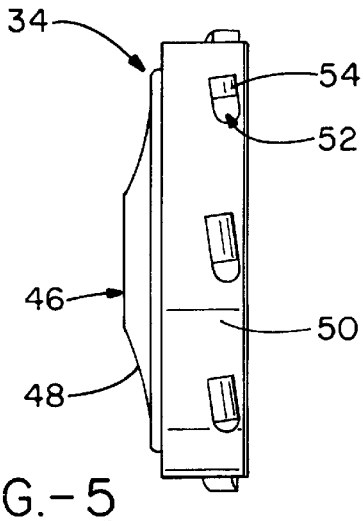
FIG.-5

BYPASS MOTOR/FAN ASSEMBLY HAVING SEPARATE WORKING AIR PASSAGES

TECHNICAL FIELD

The invention herein resides in the art of dynamoelectric machines and, more particularly, to a bypass motor/fan assembly. Particularly, the invention relates to a bypass motor assembly in which the working air is provided with a laminar exhaust flow path, increasing the efficiency of the assembly and reducing the noise associated with its operation.

BACKGROUND ART

Presently, many pieces of cleaning equipment are subjected to water or moisture. Particularly, wet/dry vacuum cleaners such as those known as utility vacs and carpet extractors operate in an environment in which the debris which is extracted from the surface being cleaned is laden in a mixture of air and water. In order to prevent the moisture laden air from entering the vacuum generating motor, bypass motors are typically used in these operations. As is known to those skilled in the art, a bypass motor/fan assembly is one in which the working air, generated by a working air fan, never passes through the motor, but is totally isolated from the motor. The motor itself has a separate motor cooling air fan which draws cooling air over the motor armature and field. Accordingly, the working air and the motor cooling air take totally separate paths, and do not mix—except possibly in an exhaust area. While both the motor cooling fan and the working fan operate on the same shaft, in a bypass motor the chambers for the working air and motor cooling air are separate and distinct from each other such that moisture laden air never enters the motor.

In the past, bypass motors have typically positioned a working air fan at an end of the motor/fan shaft, with the fan rotating within a fan shell. The shell defines a chamber within which the fan operates. An end of the fan shell is provided with an air intake, with the circumference or periphery of the shell being defined by a plurality of spaced apart exhaust apertures. The intake aperture communicates with a vacuum chamber in the cleaning device, while the exhaust ports communicate with the ambient. Typically, the fan shell simply defines a chamber in which the fan rotates and, accordingly, that chamber becomes pressurized such that the air therein eventually finds its way to an exhaust port. However, with this type of a structure, the fan operation is quite inefficient and given to the generation of significant volumes of noise.

Those skilled in the art will appreciate that previously known bypass motors are highly inefficient. The pressurization of the fan chamber and the indirect exhausting of the air therefrom gives rise to inherent inefficiencies characterized by the noise generated thereby. Both are objectionable. Accordingly, there is a need in the art for a highly efficient and quiet bypass motor for use in motor/fan applications involving moisture laden air.

DISCLOSURE OF INVENTION

In light of the foregoing, it is a first aspect of the invention to present a bypass motor/fan assembly in which the working air is exhausted through exhaust paths of uniform cross section, increasing efficiency and reducing noise.

Another aspect of the invention is the provision of a bypass motor/fan assembly in which the working air fan is maintained within an operating cavity and positioned such that the circumferential edge of the fan is in close proximity to and in communication with exhaust paths and ports.

Still a further aspect of the invention is the provision of a bypass motor/fan assembly in which the working air path goes directly from an intake port, through the fan, and to tangentially positioned exhaust paths and ports, eliminating the fan chamber of the prior art.

Yet another aspect of the invention is the provision of a bypass motor/fan assembly which is efficient and quiet in operation, easy to construct with state of the art equipment and apparatus, and conducive to implementation in vacuum producing devices subjected to moisture laden air.

The foregoing and other aspects of the invention which will become apparent as the detailed description proceeds are achieved by a bypass motor/fan assembly, comprising: a motor; a shaft passing through and driven by said motor; a motor cooling fan connected to said shaft and in juxtaposition to said motor; a fan end bracket received over an end of said motor and motor cooling fan, said fan end bracket having a first set of ramped surfaces thereon; a diffuser received by said fan end bracket, said diffuser having a second set of ramped surfaces mating with said first set of ramped surfaces, said first and second sets of ramped surfaces defining air flow paths of uniform cross section; a working air fan received upon said shaft, said working air fan having a circumferential edge in juxtaposition and communication with said flow paths; and a fan shell received over said fan end bracket, diffuser and working air fan, said fan shell having apertures in registration with said flow paths.

BRIEF DESCRIPTION OF THE DRAWINGS

For a complete understanding of the objects, techniques and structure of the invention reference should be made to the following detailed description and accompanying drawings wherein:

FIG. 1 is a partial sectional view of a bypass motor/fan assembly made in accordance with the invention;

FIG. 2 is a top plan view of the fan end bracket employed in the motor of FIG. 1;

FIG. 3 is a top plan view of the diffuser employed in the motor/fan assembly of FIG. 1;

FIG. 4 is a top plan view of the fan shell of the motor/fan assembly of the invention;

FIG. 5 is a side elevational view of the fan shell of FIG. 4;

BEST MODE FOR CARRYING OUT THE INVENTION

Figure 6:
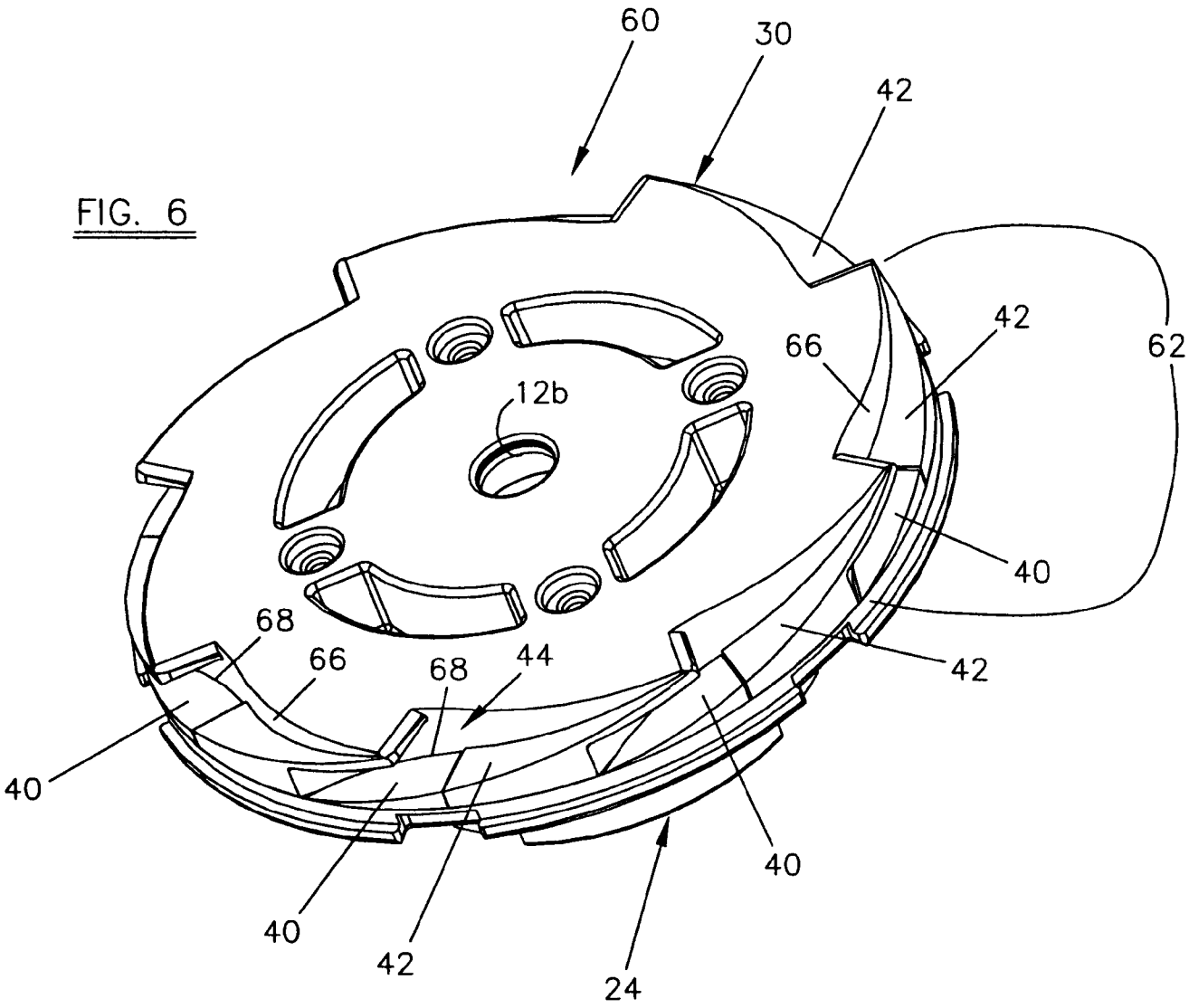
FIG. 6 is a top perspective view of the diffuser and fan end bracket assembled to one another.

Referring now to the drawings and more particularly to FIG. 1, it can be seen that a bypass motor/fan assembly made in accordance with the invention is designated generally by the numeral 10. The motor/fan assembly 10 has a shaft 12 extending axially therethrough, the shaft 12 being driven by the motor and having both motor cooling and working air fans attached thereto, as will become apparent herein. At one end of the motor/fan assembly 10 is a commutator end bracket 14 retaining a biasing spring 16 urged against a bearing 18. The bearing 18 receives the shaft 12, as is well known to those skilled in the art.

The assembly 10 further includes an armature 20 operable within field windings 22. A fan end bracket 24 extends beyond armature 20 and field windings 22 and encloses a motor cooling fan 26 at the end of the motor assembly, just described. Those skilled in the art will appreciate that the motor cooling fan 26 serves to draw motor cooling air across the armature 20 and field windings 22 when in operation. This motor cooling air is ambient air, as distinguished from the working air drawn by a working air fan to be described herein.

A bearing 28 receives the shaft 12 within an aperture of the fan end bracket 24 adjacent the cooling fan 26. Accordingly, the shaft 12 is maintained by bearings 18, 28 near opposite ends thereof.

As further shown in FIG. 1, the diffuser 30 is matingly received by the fan end bracket 24. In juxtaposition to the mated diffuser and fan end bracket is a working air fan 32, adapted for drawing air from a vessel to serve as a vacuum source in a cleaning device. The working air fan 32 is maintained within a fan shell 34 by means of a nut 36 secured to the end of the shaft 12.

With reference now to FIG. 2, it can be seen that an end of the fan end bracket 24 has an aperture 12*a* for receiving the shaft 12 therethrough. Mounting screw holes or apertures 38 are also provided therein. Of particular importance is the presence of uniformly circumferentially spaced ramped surfaces 40, adapted to receive the diffuser 30 and to define in association therewith circumferentially positioned air flow passages 41 for exhaust air from the working air fan 32 as best seen in FIG. 1. As seen in FIG. 3, the diffuser 30 has uniformly circumferentially spaced ramped surfaces 42 about the periphery thereof and defining apertures 44 at the ends thereof. The ramped surfaces 40, 42 engage with each other about the circumference of the working air fan 32 to define the air flow passages 41 of rectangular and uniform cross section, extending to and defining exhaust apertures 44. Of course, a central aperture 12*b*, for receiving the shaft 12, is provided within the diffuser 30.

With reference to FIGS. 4 and 5, it can be seen that the fan shell 34 is generally cup shaped and provided with an air inlet aperture 46 in a conical cap 48. The air inlet aperture 46 communicates directly with the eye of the working air fan 32 that is received therein. A cylindrical sidewall 50 is received over and sealingly engages with the circumferential side edges of the mating fan end bracket 24 and diffuser 30. Uniformly spaced apertures 52 are staked as at 54 within the circumferential cylindrical sidewall 50 of the fan shell 34. The exhaust apertures 52 are in registration with the apertures 44 at the ends of the air flow passages 41 defined by the engaged ramped surfaces 40, 42. These passageways are in circumferential alignment with the edge of the working air fan 32. Accordingly, as air is drawn from the chamber to the evacuator into the air inlet aperture 46, it passes through the working air fan 32 and is exhausted outwardly through the passages 41 of uniform cross section defined between the ramped surfaces 40, 42, through the apertures 44, and out of the associated exhaust apertures 52 to ambient.

With reference to FIG. 6, it can be seen that the diffuser 24 and the fan end bracket 30 are assembled to form a diffuser/fan end bracket assembly generally indicated by the numeral 60. It can be seen that the assembly 60 has a plurality of uniform circumferentially spaced ramped surfaces 62 which are formed from the ramped surfaces 42 of the diffuser 30 and the ramped surfaces 40 of the fan end bracket 24. The ramped surfaces 62 each form the respective air flow passages 41. The ramped surfaces 62 are radially and outwardly directed such that the air flow generated by the working air fan is outwardly and tangentially directed away from the assembly 60 when the fan shell 34 is placed over the assembly 60. As best seen in FIG. 1, the air flow passages 41 are in registration with corresponding staked apertures 52 such that air flow through the air flow passages 41 is smooth, laminar, and without buildup of pressure within the fan shell.

The ramp surfaces 42 of the diffuser 30 each provide a ramp wall 66 which extends from an outer periphery of the diffuser to an inner periphery in circumferential alignment with the outer periphery of the working air fan as best seen in FIGS. 1, 3 and 6.

The ramp surfaces 40 of the fan end bracket 24 provide a ramp wall 68 that is alignable with the ramp wall 66 when the diffuser and fan end bracket are assembled to one another. The ramp wall 68 extends from the inner periphery in circumferential alignment with the outer periphery of the working air fan to the outer periphery of the diffuser 30 as best seen in FIGS. 2 and 6. This outer-inner-outer feature of the ramped surface 62 facilitates the outward and tangential airflow of the working air from the aperture 46 to the staked apertures 52.

It will be appreciated that the flow of working air in the bypass motor 10 is laminar, entering into the eye of the fan 32 through the air inlet aperture 46, passing through the fan 32, and being smoothly fed into the passages at the fan edges and out of the circumferentially spaced exhaust ports or apertures 52. This laminar flow, absent any substantial buildup of pressure within the fan shell itself, greatly increases the efficiency of the bypass motor 10 and reduces the noise associated with the operation thereof in comparison to similar motors from the prior art.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A bypass motor/fan assembly comprising:

a motor;

a shaft passing through and driven by said motor;

a diffuser/fan end bracket assembly having a central aperture therethrough for rotatably receiving said shaft, said diffuser/fan end bracket assembly received over an end of said motor;

a working air fan received upon said shaft; and a fan shell having a cylindrical sidewall received over said diffuser/fan end bracket assembly and said working air fan, said fan shell having an inlet aperture, said sidewall having uniformly spaced staked apertures, said working fan drawing air through said inlet aperture and exhausting it tangentially outwardly through said diffuser/fan end bracket assembly and said staked apertures;

said diffuser/fan end bracket assembly having a plurality of uniformly circumferentially spaced ramped surfaces which form a like plurality of separate air flow passages tangentially and outwardly directed, wherein said separate air flow passages are in registration with corresponding said staked apertures such that air flow through said separate air flow passages is smooth, laminar and without buildup of pressure within said fan shell, wherein said diffuser/fan end bracket includes:

a diffuser with a first plurality of ramped surfaces, each said first ramped surface having a first ramp wall which extends from an outer periphery of said diffuser to an inner periphery in circumferential alignment with an outer periphery of said working air fan; and a fan end bracket with a second plurality of ramped surfaces that correspondingly engage with said first plurality of ramped surfaces each said second ramped surface having a second ramp wall aligned with said first ramp wall, each said second ramp wall extending from the inner periphery in circumferential alignment with the outer periphery of said working air fan to an outer peripheral of said diffuser.

2. The bypass motor/fan assembly according to claim 1, wherein an innermost periphery of said ramped surfaces are in circumferential alignment with an outer periphery of said working air fan.

3. The bypass motor/fan assembly according to claim 1, wherein said staked apertures are inclined and in registration with said ramped surfaces to facilitate the smooth laminar air flow.

4. The bypass motor/fan assembly according to claim 1, wherein each corresponding said first and second ramped surface and said first and second ramp walls form each said air flow passage to uniformly exhaust the working air.

* * * * *